United States Patent [19]

Mondini et al.

[11] Patent Number: 4,641,397

[45] Date of Patent: Feb. 10, 1987

[54] DRAFTING MECHANISM FOR SPINNING MACHINES

[75] Inventors: Giancarlo Mondini, Winterthur; Walter Hefti, Ettenhausen; Siegfried Kaufmann, Wil, all of Switzerland

[73] Assignee: Maschinenfabrik Rieter AG, Winterthur, Switzerland

[21] Appl. No.: 716,232

[22] Filed: Mar. 26, 1985

[30] Foreign Application Priority Data

Mar. 30, 1984 [CH] Switzerland ..... 1621/84

[51] Int. Cl.[4] ..... D01H 5/74

[52] U.S. Cl. ..... 19/258; 19/265; 19/280; 19/282

[58] Field of Search ..... 19/258, 260, 265, 266, 19/261, 279, 280, 281, 278, 276, 282, 284

[56] References Cited

U.S. PATENT DOCUMENTS

| | | | |
|---|---|---|---|
| 2,787,025 | 4/1957 | Solanas | 19/280 |
| 2,819,497 | 1/1958 | Dausch | 19/279 X |
| 2,870,487 | 1/1959 | Dausch | 19/265 |
| 2,881,481 | 4/1959 | Newton | 19/281 |
| 3,072,974 | 1/1963 | Stahlecker et al. | 19/281 |
| 3,205,539 | 9/1965 | Kübler et al. | 19/281 X |
| 3,278,994 | 10/1966 | Stahlecker et al. | 19/282 X |

FOREIGN PATENT DOCUMENTS

| | | |
|---|---|---|
| 69562 | 8/1984 | European Pat. Off. . |
| 2852692 | 6/1980 | Fed. Rep. of Germany . |
| 822352 | 10/1959 | United Kingdom . |

*Primary Examiner*—Louis K. Rimrodt
*Assistant Examiner*—J. L. Olds
*Attorney, Agent, or Firm*—Michael J. Striker

[57] ABSTRACT

A drafting mechanism for spinning machines for drafting a staple fiber web, a staple fiber sliver or a staple fiber slubbing has at least an input roller pair, two intermediate roller pairs, and an output roller pair each having a lower roller and a pressure roller, a first group of support elements arranged to receive the lower rollers at their both ends and a second group of support elements arranged to receive the pressure rollers at their both ends, and the support elements receiving the lower rollers and/or the support elements receiving the pressure rollers are connectable to each other on both sides of the rollers by respective connecting elements.

13 Claims, 5 Drawing Figures

Fig. 1
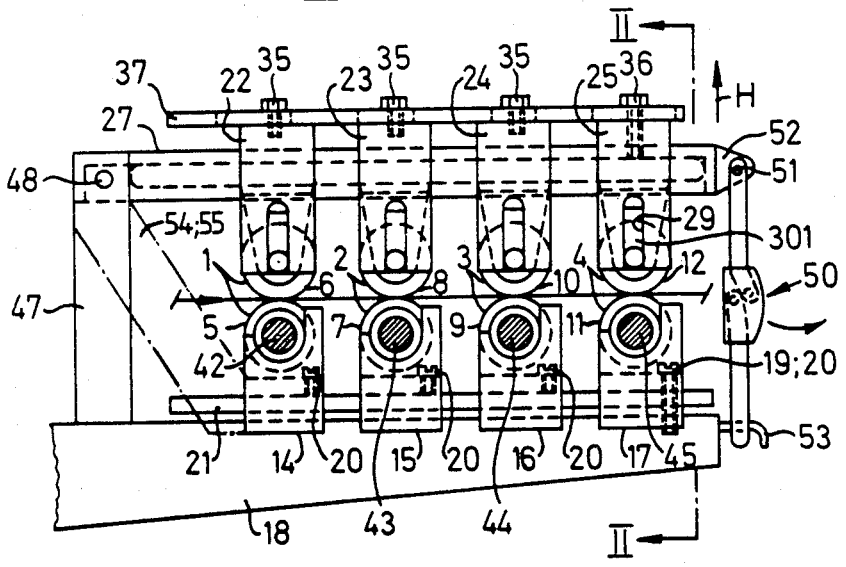
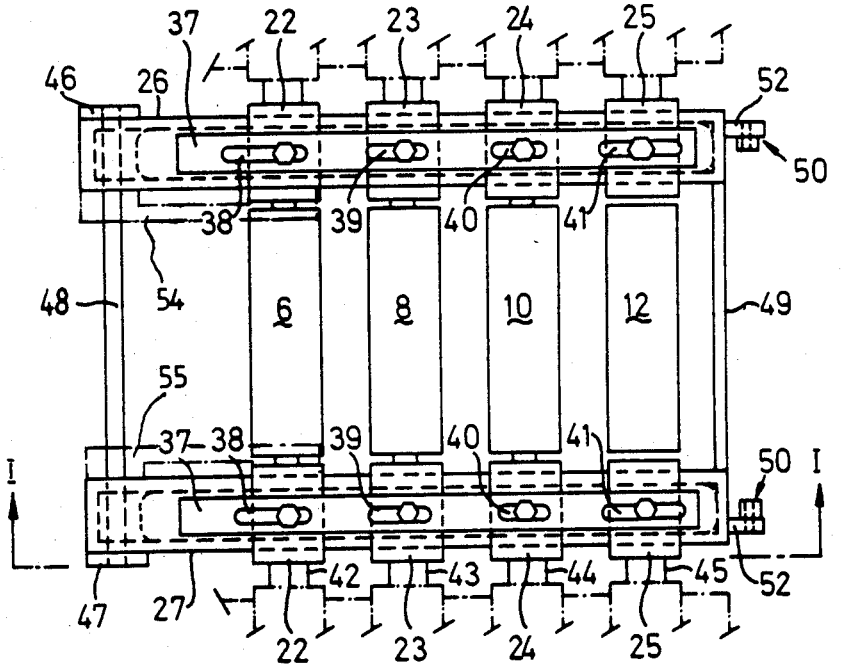
Fig. 2

DRAFTING MECHANISM FOR SPINNING MACHINES

BACKGROUND OF THE INVENTION

The present invention relates to a drafting mechanism for spinning machines for drafting a staple fiber web, a staple fiber sliver or a staple fiber slubbing. More particularly, it relates to a drafting mechanism which has at least one input roller pair, one intermediate roller pair and one output roller pair each comprising a lower roller an a pressure roller received in support elements.

Drafting mechanisms of the above-mentioned general type are known in the art. In known drafting mechanisms, staple fiber web, staple sliver and staple fiber slubbing are drafted in drafting zones each defined by two roller pairs. Each such roller pair includes a lower roller and a pressure roller which can be pressed against the lower roller. As a rule, drafting mechanisms comprise two or more drafting zones, so that at least three roller pairs are arranged one after the other with distances corresponding to the length of the drafting zones. The pressure rollers are arranged in a frame of the drafting mechanism pivotably away from the lower roller. Pressing of the pressure rollers against the lower rollers is performed by force producing means which act on the shaft bearings provided at both sides of the pressure rollers.

In order to enable adjustment of the length of the drafting zones to the requirements, the bearings which receive the lower rollers are arranged movably and fixably on rails. The same applies to the bearings which receive the pressure rollers, in that these bearings are also movable and arrestable on the frame of the drafting mechanism.

The last roller pair, as considered in transporting direction of the body of fibers, is however preferably fixedly arranged in order to avoid changes of position of these rollers relative to the subsequent elements which take up the fiber sliver or the fiber web.

If now the last drafting zone identified as the main drafting zone is to be shortened or lengthened, then the preceding roller pairs which form the break draft zones must be moved correspondingly to the same extent. When, for example two break drafting zones and one main drafting zone are provided, then during adjustment of the main drafting zone altogether three roller pairs must be displaced. This is very time-consuming.

In an arrangement in which the above-mentioned last roller pair is also arranged movably and arrestably, only the last roller pair can be displaced.

In order to perform this work more quickly, but nevertheless accurately, it is proposed in the German Published Patent Specification No. 2,852,692, that the extent of movement of the lower rollers can be read on a scale. In order to simultaneously displace the bearings of the pressure rollers associated therewith, the pressure roller is removed and a rail which, on the one hand, is adapted to the pressure roller bearings, and on the other hand, receives the lower roller, is inserted in the bearings of the pressure roller. In this manner, the lower rollers and the pressure rollers can be displaced simultaneously and to the same extent. This operation is performed for each roller pair.

A disadvantage of this method and this device, respectively, lies on the one hand, in the substitution of the pressure roller by the above-mentioned rail and remounting of the pressure roller after the displacement, and on the other hand in that in spite of this all of the roller pairs which define the break drafting zones must be adjusted one after the other.

SUMMARY OF THE INVENTION

Accordingly, it is an object of the present invention to provide a drafting mechanism for spinning machines, which avoids the disadvantages of the prior art.

More particularly, it is an object of the present invention to provide a drafting mechanism for spinning machines in which at least all pressure rollers and all lower rollers of the break drafting zones can move simultaneously.

In keeping with these objects and with others which will become apparent hereinafter, one feature of the present invention resides, briefly stated, in a drafting mechanism for spinning machines, which has at least one input roller pair, one intermediate roller pair and one output roller pair each having a lower roller and a pressure roller received in support elements, wherein the support elements receiving the lower rollers and/or the support elements receiving the pressure rollers are connectable to each other on both sides of the rollers by respective connecting elements.

When the drafting mechanism for spinning machines is designed in accordance with the present invention, it avoids the disadvantages of the prior art and attains the above specified objects.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a view showing a longitudinal section of a drafting mechanism for spinning machines, in accordance with the present invention, taken along the line I—I in FIG. 2;

FIG. 2 is a plan view of the drafting mechanism shown in FIG. 1 in accordance with the present invention;

DESCRIPTION OF A PREFERRED EMBODIMENT

Figure 3:
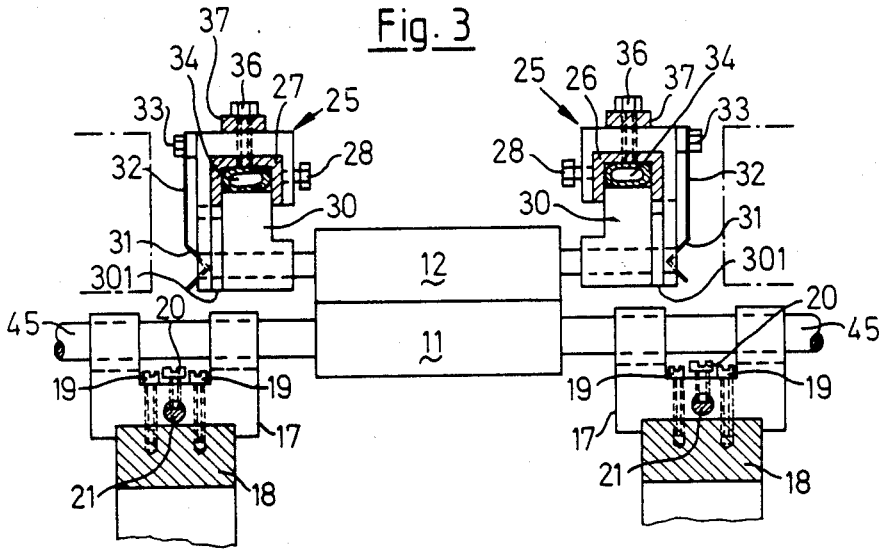
FIG. 3 is a view showing a cross-section of the drafting mechanism of FIG. 1, taken along the lines II—II in FIG. 1.
Figure 4:
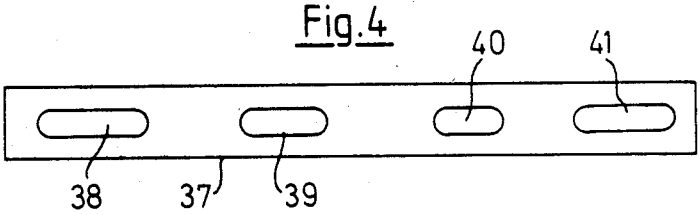
FIG. 4 is a plan view of a detail of the drafting mechanism of FIG. 1, on an enlarged scale.
Figure 5:
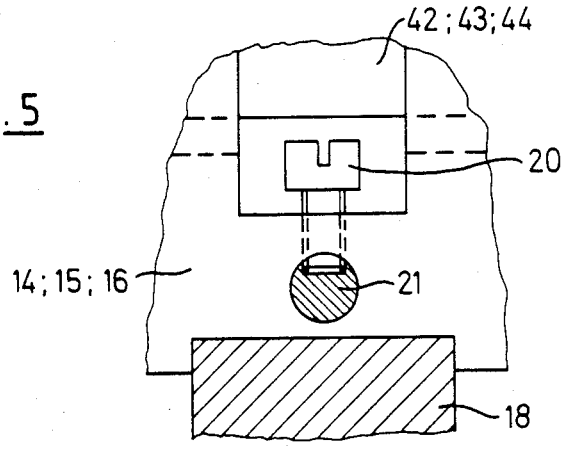
FIG. 5 is a view showing a part of the drafting mechanism of FIG. 3, on an enlarged scale.

A drafting mechanism in accordance with the present invention comprises an input roller pair 1, a first intermediate roller pair 2, a second intermediate roller pair 3, and an output roller pair 4. The input roller pair 1 includes a lower roller 5 and a pressure roller 6, the first intermediate roller pair 2 includes a lower roller 7 and a pressure roller 8, the second intermediate roller pair 3 includes a lower roller 9 and a pressure roller 10, and the output roller pair 4 includes a a lower roller 11 and a pressure roller 12. The lower rollers 5, 7, 9 and 11 are rotatably supported in bearing pairs 14, 15, 16 and 17, respectively. FIG. 1 shows only the right-hand bearing, as considered in the travelling direction of the fiber body.

As can be seen from FIG. 3, these bearings are arranged slidably on a rail 18 and secured against movement in the axial direction of the rollers.

For fixing these bearings against movement in the forward and backward directions, on the one hand either each bearing 16 of the third lower roller 9 or each bearing 17 of the last lower roller 11 (only this modification is illustrated in the drawing) is fixedly connected with the respective rail by means of screws 19. On the other hand, the bearings 14, 15, 16 and 17 of the lower rollers 5, 7, 9 and 11, are each connected by means of a screw 20 with a connecting rail 21.

The pressure rollers 6, 8, 10 and 12 respectively are received on both sides by bearing saddles 22, 23, 24 and 25. FIG. 1 shows only the right-hand bearing saddle, as considered in the travelling direction of the fiber body, while FIG. 3 shows only the bearing saddles 25 receiving the pressure roller 12.

The bearing saddles in turn lie on respective frame elements 26 and 27 of the drafting mechanism and are each fixed by means of an adjusting screw 28 frictionally against displacement on the elements 26 and 27, respectively.

Each bearing saddle served for receiving a bearing 30 and has a guide slot 29. A guide portion 301, which forms a part of each bearing 30 is inserted in the guide slot 29, as shown in FIG. 3. Thereby, the pressure rollers are supported in the force directions parallel to the elements 26 and 27, respectively. Displacement of the bearing 30 in the axial direction of the rollers is avoided by the guidance of the guide portions 301 on the inner faces of the elements 26 and 27, respectively, as only shown in FIG. 3.

For retaining the pressure rollers when the frame of the drafting mechanism is pivoted upward, (not shown) in the direction of the arrow H in FIG. 1, a portion 31 of a leaf spring 32 extends into the bore of the bearing 30. The leaf springs 32 are each fixed by means of a screw 33 to the bearing saddles 22, 23, 24 and 25, respectively, as shown in FIG. 3.

The resilient element 34 is provided between each bearing 30 and the elements 26 and 27. This resilient element produces the contact pressure between the pressure rollers and lower rollers.

The saddles 22, 23 and 24 are connected by means of a screw 35, and the saddle 25 is connected by means of a screw 36 with a connecting plate 37.

The screw 36 also extends into the elements 26 and 27 respectively, whereby the bearing saddles 25 are stationary relative to the elements 26 and 27. This modification is used only when the pressure roller 12 of the output roller pair is to be arranged stationarily.

As already mentioned previously, the second intermediate roller pair 3 can be arranged stationarily instead of the output roller pair 4, and the output roller pair 4 can be arranged movably. In such a modification, the screws 36 fix the saddles 24 to the elements 26 and 27.

In order to enable changes in the mutual position of the pressure rollers, the connecting plate 37 has sufficiently long slots 38, 39, 40 and 41. The length and the position of the slots relative to one another depends upon the desired displacement of the pressure rollers and must be determined from case to case.

Shafts 42 and 43 and 44 or 45 which carry the lower rollers are driven so that the shafts 42 and 43 are driven by means of cardan linkages, whereas the shafts 44 and 45 are driven directly from corresponding transmissions. Through the arrangement of the transmission with the cardan linkages, there is provided the possibily of moving the shafts from their positions shown in the drawings along the members 18. The movement of the pressure rollers and/or lower rollers is always necessary when different fiber lengths are present in the material to be drafted.

Since, however, as a rule, the movement takes place in the main drafting zone limited by the roller pairs 3 and 4, and the break drafting zone or the break drafting zones maintain their lengths, the roller pairs 1, 2 and 3 can be moved to the same extent. For effecting this, on the one hand the screws 36 (FIGS. 1 and 3) and the screws 28 must be loosened, and on the other hand the screws 20 provided in the bearings 17 must be loosened. Because of the connection of the bearings 14, 15 and 16 by means of the connecting rail 21, and because of the connection of the bearing saddles 22, 23 and 24 by means of a connecting plate 37, these bearing elements can be moved together.

Finally, the elements 26 and 27 of the frame of the drafting mechanism are pivotably arranged by means of a shaft 48 received in the supports 46 and 47. The supports 46 and 47 are fixedly connected with the rails 18. The frame of the drafting mechanism is formed so that the elements 26 and 27 are fixedly connected by a bar 49 at their ends opposite to the shaft 48. By means of a clamping device 50 associated with each element 26 and 27, the frame of the drafting mechanism is secured in its operating position shown in FIGS. 1 and 3.

The clamping device 50 on the one hand is pivotally arranged by means of a pivot shaft 51 on a strap 52 which is fixedly associated with each element 26 and 27. On the other hand, it is suspended on a hook 53 fixedly associated with each rail 18.

One modification is that, as indicated with dash-dot lines in FIGS. 1, 2 and 3, supports 54 and 55 can be used in place of the supports 46 and 47. The supports 54 and 55 on the one hand receive the shaft 48, and on the other hand are mounted on the bearings 14. As a result of this modification, the bearing saddles 24 are fixed by means of screws 36 on the elements 26 and 27, respectively, and the bearing saddles 25 which can be clamped by screws 35 are arranged movably on the elements 26 and 27, respectively.

For changing the main drafting field, the screws 35 and 28 provided in the bearing saddles 25 and the screws 20 provided in the bearings 17 must be loosened. After this, the bearings 14, 15 and 16 and therewith necessarily also the elements 26 and 27, together with the bearing saddles 22, 23 and 24 are moved to the desired extent and then the above-mentioned screws 20 are again tightened.

Subsequently the bearing saddles 25 must be adjusted relative to the bearing saddles 24 to the distance corresponding to the newly adjusted main drafting field and secured by means of the screws 35.

Finally, it is mentioned that it is not necessary to move the support elements of the lower rollers and the pressure rollers to the same extent. When, for example, wrapping of the body of fibers to be drafted about one or the other roller is desired, or at least is tolerable, the shaft distances between adjacent rollers can be different. Thereby there is provided the possibility that either only the pressure rollers 6, 8, 10 and 12 or only the lower rollers 5, 7, 9 and 11 are each connected to one another by the connecting element 21 or 37, respectively.

It will be understood that each of the elements described above, or two or more together, may also find a useful application in other types of constructions differing from the types described above.

While the invention has been illustrated and described as embodied in a drafting mechanism for spinning machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A drafting mechanism for spinning machines for drafting a staple fiber web, a staple fiber sliver, or a staple fiber slubbing, comprising a plurality of roller pairs including at least one input roller pair, one intermediate roller pair, and one output roller pair, each of said roller pairs including a lower roller and a pressure roller having opposed end regions; means for supporting said rollers and including a first group of support elements receiving said lower rollers and arranged so that at least some of said support elements of said first group are displaceable relative to each other, and a second group of support elements receiving said pressure rollers, the support elements of at least one of said groups of support elements being connectable with one another at said opposed end regions of the respective rollers; and further comprising connecting means for connecting the support elements of said at least one group of said support elements and including at least one connecting element.

2. A drafting mechanism as defined in claim 1, wherein the support elements of the other of said groups of said support elements are also connectable with one another at said both opposed end regions of the respective rollers; and further comprising connecting means for connecting the support elements of said other group of said support elements and including another connecting element.

3. A drafting mechanism as defined in claim 1; and further comprising rails which form a part of a machine frame, the support elements of said first group of said support elements being displaceably arranged on said rails.

4. A drafting mechanism as defined in claim 1; and further comprising a frame having frame elements, the support elements of said second group of said support elements being displaceably arranged on said frame elements.

5. A drafting mechanism as defined in claim 4, wherein said frame is liftable away of said lower rollers.

6. A drafting mechanism as defined in claim 1; and further comprising rails which form a part of a machine frame so that the support elements of said first group of said support elements are adjustably arranged on said rails; and a frame having frame elements so that the support elements of said second group of said support elements are displaceably arranged on said frame, said frame being pivotably mounted indirectly on said rails, the support elements which support at least one roller of said output roller pair being fixedly mounted on said rails or on said frame, respectively, while the support elements of at least one roller of the other roller pairs being arranged displaceably relative to one another.

7. A drafting mechanism as defined in claim 6, wherein the support elements of the other of said rollers of said output roller pair are also fixedly mounted on said rail or said frame respectively, while the support elements of the other of said rollers of said other roller pairs are also arranged displaceably relative to each other.

8. A drafting mechanism as defined in claim 1; and further comprising rails forming a part of a machine frame so that the support element of said first group of said support elements are displaceably arranged on said rails; and a frame having frame elements so that the support elements of said second group of said support elements are displaceably arranged on said frame elements, said frame being pivotably arranged indirectly on the support elements of the lower roller of said input roller pair, the support elements of the lower roller of said output roller pair being fixedly mounted on said rails while the support elements of the lower rollers of the other roller pairs are arranged displaceably relative to one another.

9. A drafting mechanism as defined in claim 1; and further comprising rails which form a part of a machine frame so that said support elements of said first group of said support elements are displaceably arranged on said rails; and a frame having frame elements so that the support elements of said second group of support elements are displaceably arranged on said frame elements, said frame being pivotably arranged indirectly on the support elements of the lower roller of said input roller pair, the support elements of said intermediate roller pair preceding said outlet roller pair being fixedly mounted on said frame element, while the support elements of the pressure rollers of the other roller pairs are arranged displaceable relative to each other.

10. A drafting mechanism as defined in claim 1, wherein said one connecting element is connectable by a friction interference with the support elements of said one group of said support elements.

11. A drafting mechanism as defined in claim 2, wherein said other connecting element is connectable by friction interference with the support element of said other group of said support element.

12. A drafting mechanism as defined in claim 1, wherein said one connecting element is arranged displaceably relative to the support elements of said one group of said support elements.

13. A drafting mechanism as defined in claim 2, wherein said other connecting element is arranged displaceably relative to the support elements of said other group of said support elements.

* * * * *